US005510766A

United States Patent [19]

Harman et al.

[11] Patent Number: 5,510,766

[45] Date of Patent: Apr. 23, 1996

[54] INTRUSION DETECTION SYSTEM

[75] Inventors: Robert K. Harman, Kanata; André Gagnon, Hull, both of Canada

[73] Assignee: Auratek Security Inc., Hull, Canada

[21] Appl. No.: 214,007

[22] Filed: Mar. 16, 1994

Related U.S. Application Data

[63] Continuation-in-part of Ser. No. 944,190, Sep. 11, 1992, abandoned.

[30] Foreign Application Priority Data

Oct. 9, 1993 [WO] WIPO ..... PCT/CA93/00366

[51] Int. Cl.[6] ..... G08B 13/18

[52] U.S. Cl. ..... 340/552; 333/237

[58] Field of Search ..... 340/552–554, 340/566, 541; 333/237; 367/93–94; 342/27–28

[56] References Cited

U.S. PATENT DOCUMENTS

| | | | |
|---|---|---|---|
| 3,439,358 | 4/1969 | Salmons | 340/552 |
| 3,794,992 | 2/1974 | Gehman | 340/552 X |
| 4,213,122 | 7/1980 | Rotman | 340/552 |
| 4,224,607 | 9/1980 | Poirier et al. | 340/552 |
| 4,328,487 | 5/1982 | Cheal | 340/554 |
| 4,400,695 | 8/1983 | Rittenbach et al. | 340/566 |
| 4,419,659 | 6/1983 | Harman et al. | 340/552 |
| 4,673,935 | 6/1987 | Spencer | 340/552 X |
| 4,879,544 | 11/1989 | Maki et al. | 340/552 |

FOREIGN PATENT DOCUMENTS 2145331 3/1973 Germany .

*Primary Examiner*—Thomas Mullen
*Attorney, Agent, or Firm*—Thomas Adams

[57] ABSTRACT

In an intrusion detection system comprising an open transmission line (10), for example a "leaky cable", and a receiver unit (12S,12T,14S,14T,16) for processing a radio frequency signal received by the line to detect perturbations caused by an intruder (28), problems of nonlinear sensitivity due to line attenuation are resolved by combining perturbation signals ($R_S$, $R_T$) from both ends of the open transmission line. A processor unit (18) computes logarithmic values of the perturbation signals from the opposite ends of the line and combines them to detect presence of an intruder. The sum of the logarithmic values may be used to determine presence of the intruder and the difference between them may be used to determine the location of the intruder relative to the end of the line. The processor may also use phase information from the two perturbation signals to facilitate detection in the presence of multipath effects. Reference signals (LO,$IF_T$, RF) and power may be transmitted between receiver units (12S,14S, 12T,14T,16) by way of the open transmission line (10) itself. The system may employ several transmissions having different frequencies, in which case the processor (18) will sum perturbation signals for all transmission frequencies for each end of the line, combine the two sums, and compare the result with a predetermined threshold T.

25 Claims, 9 Drawing Sheets

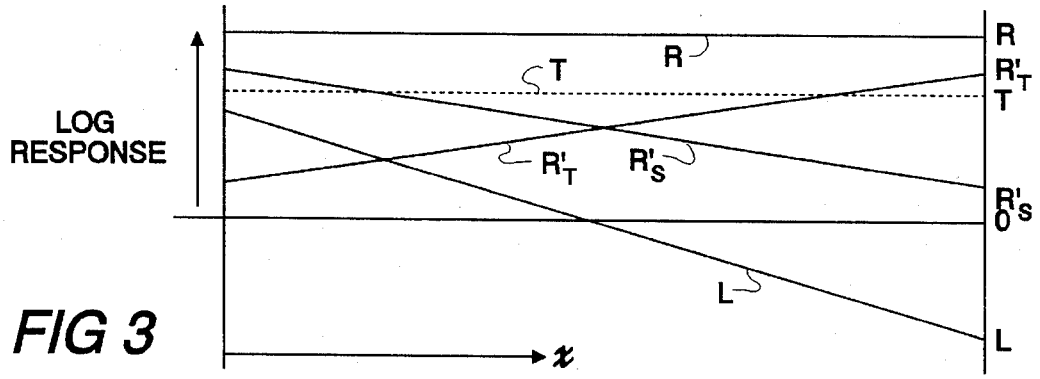
FIG 3
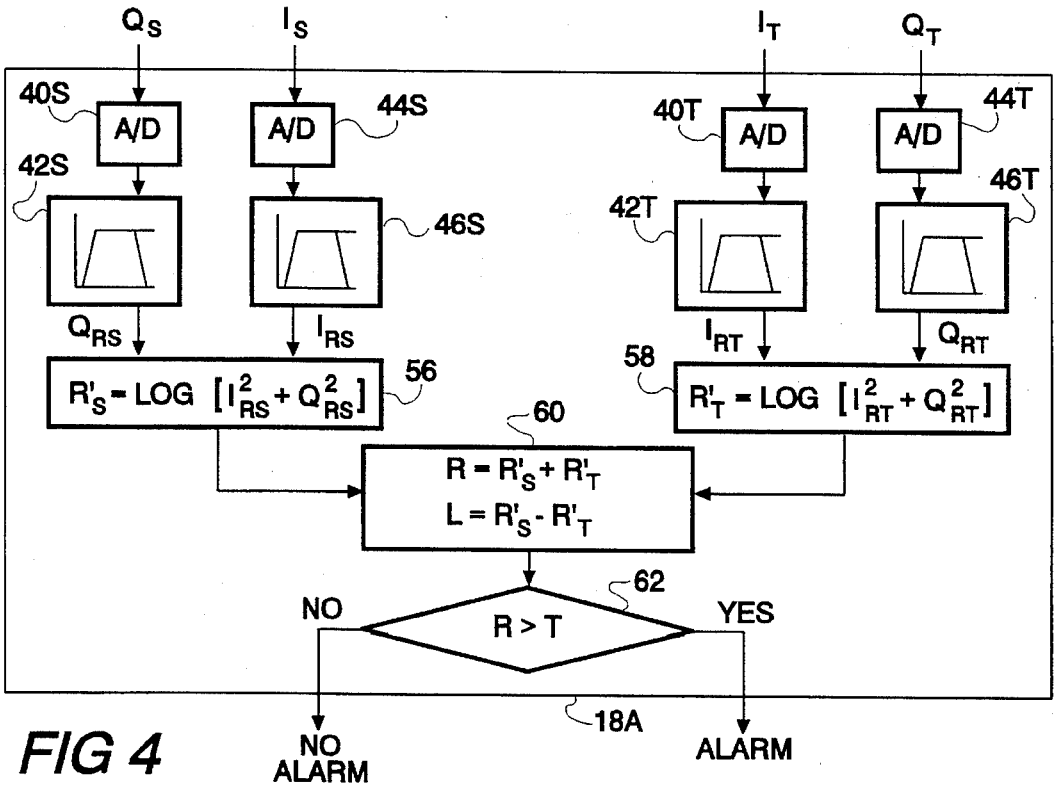
FIG 4
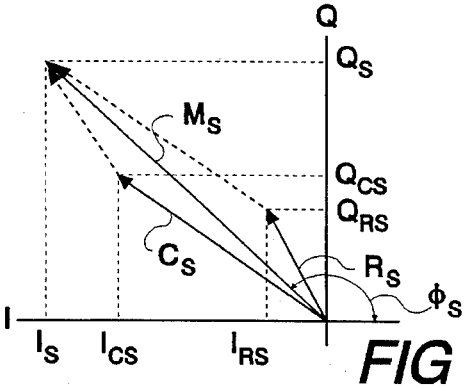
FIG 5A
FIG 5B
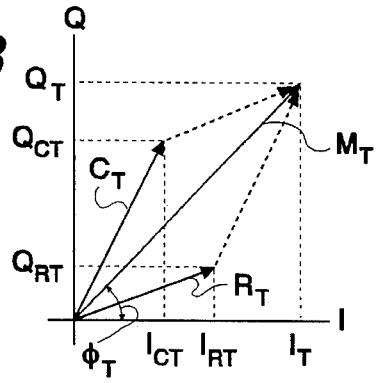

INTRUSION DETECTION SYSTEM

This is a Continuation-in-Part of patent application Ser. No. 07/944,190 filed Sep. 11, 1992, now abandoned.

BACKGROUND OF THE INVENTION

1. Technical Field

The invention relates to intrusion detection systems and in particular to intrusion detection systems which comprise an open or "leaky" transmission line, for example a leaky cable, for receiving a radio frequency signal and receiver means attached to the open transmission line for processing the received radio frequency signal to detect perturbations caused by an intruder in proximity to the open transmission line.

2. Background Art

It is desirable for such an intrusion detection system to have uniform sensitivity along the length of the open transmission line. All transmission lines, including open transmission lines, attenuate signals as they propagate along their length. This attenuation is due to resistive losses in the conductors, to losses in surrounding dielectric materials, or to radiation. Usually attenuation is dominated by resistive losses. With a line receiver connected to one end of the line, and the detector sensitivity set to detect a large intruder, for example a human, at the far end of the line, the alarm could be triggered by a small animal, for example a rodent, adjacent the near end of the line. In systems employing a leaky coaxial cable as the line, this problem has been addressed by increasing the aperture size with distance along the cable (cable grading). Such graded cables are very expensive, which is a disadvantage for large area protection, and must be supplied and stocked in standard lengths, which leads to additional expense.

U.S. Pat. No. 4,224,607 (Poirier) issued Sep. 23, 1980, discloses an intrusion detection system comprising a length of leaky transmission line encompassing the region to be protected, a receiving antenna within the region, an R.F. transmitter and a remotely located receiver and detector. Effects of attenuation along the line are reduced by switching the transmitter periodically to opposite ends of the leaky cable. Nevertheless, this is only a partial solution. The sensitivity is still greater at the ends of the cable than at the middle of the cable so the system would not necessarily provide detection anywhere along the cable while not being susceptible to false alarms from the more sensitive start end of the cable. Where a longer line is needed to protect a greater area, especially if an inexpensive cable with a relatively high attenuation is used, the variation in sensitivity would be even greater.

SUMMARY OF THE INVENTION

The present invention seeks to eliminate, or at least mitigate, the disadvantages of the known intrusion detection systems and to provide an improved leaky cable intrusion detection system.

To this end, according to one aspect of the present invention, an intruder detection system comprises an open transmission line; receiver means connected to both ends of the transmission line; means for providing at the receiver means a reference local oscillator signal (LO) and a reference intermediate frequency signal ($IF_{REF}$); and processor means for processing signals output from the receiver means. The receiver means is responsive to the reference local oscillator signal and the reference intermediate frequency signal to extract from a first radio frequency signal received at one end of the line a first baseband signal comprising a first perturbation signal produced by an intruder in proximity to the line and to extract from a second radio frequency signal received at the other end of the line a second baseband signal comprising a second perturbation signal. The processor determines the presence of the intruder in dependence upon both the first and second perturbation signals.

The system may, advantageously, be capable of receiving, selectively, a plurality of transmissions at different frequencies, perhaps different commercial stations. The processor means may conveniently select the different frequencies by varying the reference local oscillator signal frequency. The processor means may also be capable of adjusting receiver gain to compensate for different signal strengths of the different transmissions. The particular frequencies selected, and the corresponding gain factors, may be determined during a preliminary calibration of the installed system.

It is also desirable for the system to be capable of determining the position of the intruder along the cable. In preferred embodiments of the invention, the processor means also derives the distance to the intruder from the start end of the line in dependence upon the first perturbation signal and the corresponding perturbation signal, preferably in proportion to the difference between logarithmic values derived from them.

The receiver means may comprise first receiver means and second receiver means connected to opposite ends, respectively, of the transmission line, both tuned to the frequency of the radio frequency signal and coupled for synchronous detection of the signal. Preferably, the first and second receiver means both use the reference local oscillator signal to detect the radio frequency signal at each end of the line and produce respective intermediate frequency signals.

Advantageously, communication of signals and power between the first and second receiver means may take place via the line itself.

In preferred embodiments of the invention, the means for providing the reference local oscillator signal and the reference intermediate frequency signal comprises a third receiver which receives the transmitted radio frequency signal directly from a remote transmitter, for example a commercial radio or television station or a navigation signal transmitter, and derives the reference signals from the direct radio frequency signal. Where two receiver means are involved, the reference intermediate frequency signal will synchronize them to the transmitted radio frequency signal and to each other.

In preferred embodiments of the invention, the first and second receiver means each comprise a line receiver and a demodulator. Each line receiver is connected to the transmission line and uses the reference local oscillator signal to derive its intermediate frequency signal from the line signal. The demodulator will then use the reference intermediate signal to demodulate the intermediate frequency signal from the associated line receiver to provide the perturbation signals representing the perturbation created by the intruder. The perturbation signals from the first and second receiver means are processed by the processing means, as previously mentioned, to detect the presence of an intruder or/and the location of the intruder along the open transmission line.

Preferably each demodulator provides in-phase and quadrature signal components of the perturbation signal at its end of the line and the processor combines the magnitude and phase information of each of the perturbation signals to detect the presence of an intruder. One means of combining the signals from the two ends of the line is to add the logarithmic values of the sum of the squares of the in-phase and quadrature component signals. In this case, the system indicates the presence of the intruder when the sum of the two logarithms exceeds a predefined threshold. The processor may also use the difference between the two magnitude logarithms to determine the distance of the intruder from the start of the line.

In situations where the signal to noise ratio is high, the use of logarithmic values is a very practical way to combine the signals from both ends of the line. In situations involving poor signal to noise conditions, however, performance can be enhanced by using linear summation of magnitudes of the signals from the two ends of the line and comparing the sum with a variable threshold. More particularly, in one preferred embodiment of the invention, the perturbation signals from opposite ends of the line are added and compared with a threshold which varies according to the distance along the line, especially according to the ratio between the perturbation signal magnitudes at various discrete positions along it. Thus, in a middle region of the line, the ratio might be 2:1, increasing in steps to, say, 4:1 at the ends.

Where a plurality of transmissions at different frequencies are involved, the processor means may be arranged to sum a corresponding plurality of first perturbation signals at the different frequencies for said one end of the line, sum a corresponding plurality of second perturbation signals at the different frequencies for said other end of the line, and combine the first sum and second sum to give a combined value. The processor means may then compare the combined value with one of a plurality of threshold levels, a minimum of the levels corresponding to the centre of the line and maxima of the levels corresponding to respective end portions of the line. The particular one of the levels may be chosen in dependence upon a ratio between the first sum and second sum.

Various objects, features, aspects and advantages of the present invention will become more apparent from the following detailed description, in conjunction with the accompanying drawings, of a preferred embodiments(s) of the invention.

BRIEF DESCRIPTION OF DRAWING(S)

FIG. 3 illustrates various signals in the system;

FIG. 4 illustrates functions of a processor means of the system of FIG. 1; FIGS. 5A and 5B are vector diagrams illustrating corresponding signals at opposite ends of the open transmission line;

DESCRIPTION OF THE PREFERRED EMBODIMENT(S)

Figure 1:
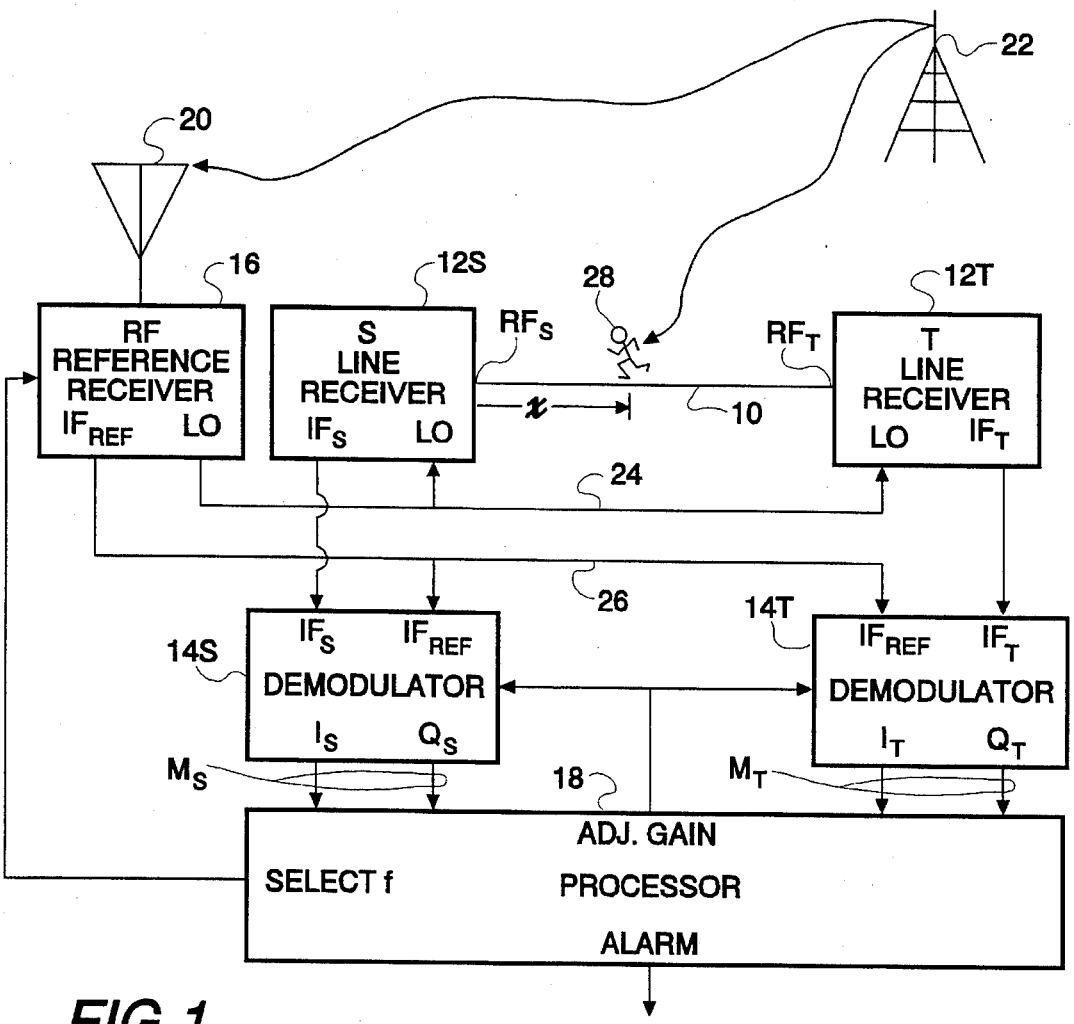
FIG. 1 is a general schematic representation of an intruder detection system comprising an open transmission line and receiver means for detecting intruder-induced perturbations of a radio frequency signal on the line.

Referring to FIG. 1, an intruder detection system comprises an open or "leaky" transmission line 10, conveniently an apertured coaxial cable of the kind usually called a "leaky cable". The line 10 is connected to receiver means comprising two line receivers 12S and 12T coupled to coherent demodulators 14S and 14T, respectively, and a reference receiver 16. The receiver means are controlled by, and supply signals to, a microcontroller or digital signal processor 18. The reference receiver 16 has an antenna 20 for direct reception of a radio frequency signal transmitted by a remote transmitter 22 of a commercial radio or television station. The reference receiver 16 derives from the received radio frequency signal a reference local oscillator signal LO, which it supplies on line 24 to both of the line receivers 12S and 12T, and a reference intermediate frequency signal $IF_{REF}$ which it supplies on line 26 to the demodulators 14S and 14T.

The line receivers 12S and 12T are connected to the start and the termination, respectively, of the open transmission line 10 and will receive the radio frequency signal from transmitter 22 via the line 10.

Where the setting is substantially ideal, with a homogenous medium surrounding the open transmission line 10 and a uniformly constructed line (no discontinuities in the field of the surface wave), the open transmission line 10, properly terminated, receives only a very weak signal from the radio transmitter 22. When the intruder 28 moves in proximity to the open transmission line 10, a discontinuity is created in the characteristic impedance of the line 10 and the radio frequency signal striking the intruder 28 is introduced into the line 10, where it propagates both to the start and termination ends of the line 10. Hence the line receivers 12S and 12T receive perturbed radio frequency signals $RF_5$ and $RF_T$, respectively, which each comprise a component due to the perturbation signal coupled by the intruder 28 into the open transmission line 10. In the case of a system operating in the FM band, the modulation caused by a human intruder moving between 0.02 and 8 meters per second is between, approximately, 0.005 Hz. and 6 Hz.

Assuming that the reference antenna 20 is suitably located, the reference intermediate frequency signal $IF_{REF}$ is not disturbed by the intruder 28, whereas the intermediate frequency signals $IF_S$ and $IF_T$ produced by the line receivers 12S and 12T are modulated by the intruder 28.

The line receivers 12S and 12T, by sharing the same local oscillator signal LO, are tuned precisely to the same station as reference receiver 16, so their intermediate frequency signals IF5 and $IF_T$ contain the same broadcast frequency modulation but at the IF frequency. Because these intermediate frequency signals are coherent, the demodulation process effectively eliminates the broadcast modulation leaving only the modulation induced via the line 10. In particular, when the intermediate frequency signal $IF_{REF}$ from the reference receiver 16 is mixed with the intermediate frequency signals $IF_S$ and $IF_T$ from the line receivers 12S and 12T in demodulators 14S and 14T, corresponding baseband signals $M_S$ and $M_T$ comprising amplitude and phase modulation due to the intruder 28, are detected.

Figure 2:
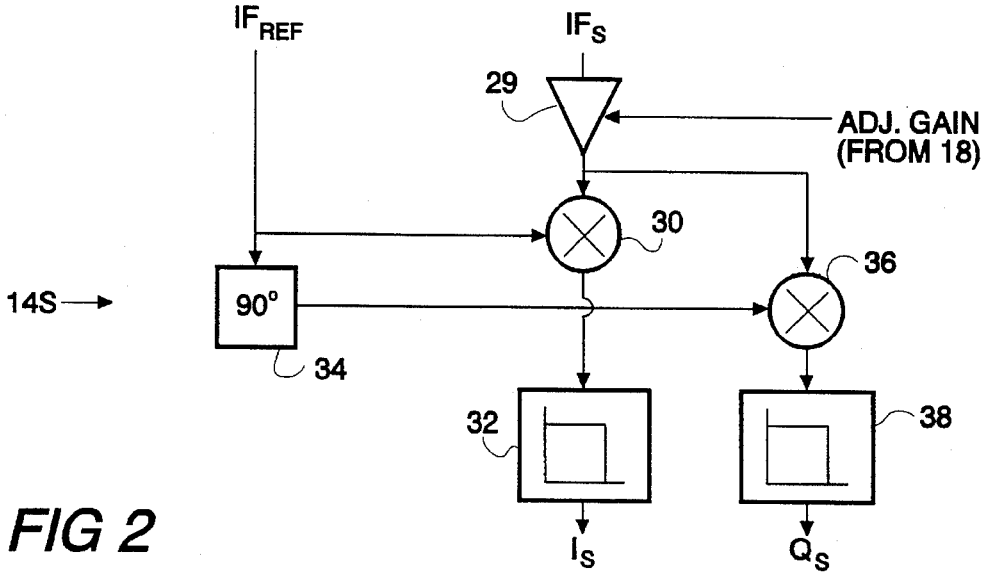
FIG. 2 illustrates a demodulator of the system shown in FIG. 1.

Demodulator 14S is shown in detail in FIG. 2; demodulator 14T being identical. An amplifier 29, the gain of which is variable under the control of the processor 18, amplifies the intermediate frequency signal $IF_S$ from the line receiver 12S and supplies it to a mixer 30. The mixer 30 mixes the reference intermediate frequency signal $IF_{REF}$ with the intermediate frequency signal $IF_S$ from the line receiver 12S to extract the baseband signal $M_S$. Since the output of mixer 30 includes all the usual mixing products, it is supplied to a low pass filter 32 which eliminates all of the upper cross products above about 3.75 Hz. leaving only the in-phase baseband component $I_S$ of baseband signal $M_S$. The reference intermediate frequency signal $IF_{REF}$ is delayed by 90 degrees in a quadrature hybrid circuit 34 before being supplied to a second mixer 36 which mixes it with the intermediate frequency signal $IF_S$. The output of mixer 36 is filtered by a second low pass filter 38 to remove frequencies above about 3.75 Hz., resulting in the quadrature baseband component $Q_S$ of baseband signal $M_S$.

Referring again to FIG. 1, demodulator 14S supplies the in-phase and quadrature components $I_S$ and $Q_S$ of the start-end baseband signal $M_S$ to the digital signal processor 18. Similarly, the demodulator 14T, having used the reference intermediate frequency signal $IF_{REF}$ and the intermediate frequency signal $IF_T$ from line receiver 12T to produce corresponding in-phase and quadrature components $I_T$ and $Q_T$ for the termination baseband signal $M_T$, supplies the components $I_T$ and $Q_T$ to the digital signal processor 18.

The digital signal processor 18 uses the in-phase and quadrature signals $I_S$, $Q_S$, $I_T$ and $Q_T$ from both demodulators 14S and 14T to compute a logarithmic value, as will be described in more detail later, and compares this logarithmic value with a reference or threshold, illustrated in FIG. 3 by the dashed line T. If this combined logarithmic value exceeds the threshold T, the processor 18 generates an alarm indicating that an intruder 28 is within the detection zone somewhere along the open transmission line 10.

In an ideal case, the open transmission line 10 does not pick up any of the radio transmissions unless an intruder 28 is in proximity to the line. In practice, however, stationary objects and line imperfections scatter the transmissions and introduce "fixed clutter" signals into the open transmission line 10 along its length. Also, slow environmental changes occur below the passband and higher frequency responses above the passband may be caused by flying birds, etc. Consequently, the processor 18 processes the baseband signals $M_S$ and $M_T$ in such a way that signals introduced into the line 10 at frequencies outside the range 0.005 Hz. to 6 Hz., mentioned above, will be excluded. Processing of the baseband signals by processor 18 is illustrated in FIG. 4. For the purpose of describing the processing, it is convenient to represent the base band outputs $M_S$ and $M_T$ of the demodulators 14S and 14T, respectively, vectorially as illustrated in FIGS. 5A and 5B, with the clutter represented by vectors $C_S$ and $C_T$ and the perturbation components due to the intruder by vectors $R_S$ and $R_T$. Thus, the in-phase and quadrature components $I_S$ and $Q_S$ from demodulator 14S include clutter components $I_{CS}$ and $I_{CT}$ and intruder perturbation signal components $I_{RS}$ and $Q_{RS}$, combining to give a magnitude of $M_S$. Similarly, the in-phase and quadrature response components $I_T$ and $Q_T$ of demodulator 14T include clutter components $I_{CT}$ and $Q_{CT}$ and intruder perturbation signal components $I_{RT}$ and $Q_{RT}$ combining to give a magnitude of $M_T$.

As shown in FIG. 4, initially the processor 18 digitizes and filters the in-phase and quadrature components. Normal precautions need to be taken to digitize at a sufficient rate to eliminate aliasing and with a sufficient number of bits to provide adequate dynamic range to accommodate the expected range of modulation.

The quadrature signal component $Q_S$ from low pass filter 38 in demodulator 14S (FIG. 2) is digitized by analogue-to-digital converter 40S and filtered by a band pass filter 42S, with a lower cutoff of about 0.005 Hz. and an upper cutoff of about 6 Hz, to derive the incremental intruder response vector component $Q_{RS}$. In a similar way, the in-phase signal component Is from low pass filter 32 (FIG. 2) is digitized by analogue-to-digital converter 44S and filtered by band pass filter 46S to derive the incremental intruder response vector component IRS. The in-phase and quadrature signal components $I_T$ and $Q_T$ from the demodulator 14T are processed in like manner by analogue-to-digital converters 40T and 44T and band pass filters 42T and 46T to give corresponding incremental intruder response or perturbation signal components $I_{RT}$ and $Q_{RT}$, respectively.

The lower cutoff frequency of each of the band pass filters 42S, 42T, 46S, 46T is in the order of 0.005 Hz to pass the perturbation signal due to an intruder moving faster than 0.002 m/sec. while removing the environmental drift and fixed clutter information. The upper cutoff frequency of each of the bandpass filters 42S, 42T, 46S and 46T, is in the order of 6 Hz. to pass the perturbation signal due to the intruder 28 moving slower than about 8 meters/second while removing all higher frequency noise.

As indicated by function box 56, the processor 18 computes the value $R_S'$ as the logarithm of the sum of the squares of the corresponding incremental responses $IR_S$ and $Q_{RS}$, and, as indicated by function box 58, the response $R_T'$ from incremental responses $I_{RT}$ and $Q_{RT}$. The processor 18 computes the sum R and the difference L of the logarithmic responses $R_S'$ and $R_T'$ as indicated by box 60. The sum R is then compared to threshold T, as shown in decision box 62, to determine whether or not an intruder is present and, if so, generate an alarm signal.

Once an intruder is determined to be present, the difference L between the logarithmic responses is determined to indicate where the intruder is located along the length of the open transmission line 10 relative to the start of the line 10. The difference L between the logarithmic values $R_S'$ and $R_T'$ of the perturbation signals is linear and, as shown in FIG. 3, decreases rapidly as the intruder moves along the length of the open transmission line 10. The magnitude of this difference L between the logarithmic values is directly proportional to the intruder's distance x from the start end of the open transmission line 10. Hence, the digital signal processor 18 is able to determine the intruder's location along the open transmission line 10.

Thus, the system takes account of the attenuation of signals propagating along the length of the open transmission line 10 to locate the intruder 28. Attenuation causes signals propagating along transmission lines to decay exponentially with distance. Hence, a logarithmic function of the exponential attenuation with distance along the length of the line becomes linear.

In FIG. 3, the ideal magnitude of the logarithmic perturbation signal for the start of the line due to an intruder 28 walking along the length of the open transmission line 10 is represented by the sloping line $R_S'$. The slope of this line $R_S'$ is determined by the attenuation of the open transmission line 10. Likewise the magnitude of the logarithmic perturbation signal for the termination end of the line is shown as sloping line $R_T'$. It will be noted that, because line receivers 12S and 12T are at opposite ends of the open transmission line 10, the slopes of lines $R_S'$ and $R_T'$ are equal and opposite. Adding the logarithmic values $R_S'$ and $R_T'$ yields a constant magnitude along the length of the open transmission line 10, as depicted by line R in FIG. 3. Thus, it will be seen that the combined logarithmic response from line receivers 12S and 12T is independent of the intruder's location along the length of the open transmission line 10.

The actual level of the threshold T, and hence the sensitivity of the system, will be determined by the processor 18 following an initial set-up phase. As shown in FIG. 1, the processor 18 controls the tuning of the reference receiver 16 by means of the control signal Select f, and the associated gain settings for the demodulators 14S and 14T by means of the gain control signal ADJ. GAIN. During the initial system set-up phase, the processor 18 controls the reference receiver 16 to scan the entire FM band so as to select the most desirable station frequency for use by the system. Where, as will be described later, the system uses a plurality of transmissions at different frequencies, the processor 18 will generate a table of available stations and appropriate gain settings for the demodulators 14S and 14T to maintain the signal components $I_S$,$Q_S$ and $I_T$,$Q_T$ at a constant amplitude. The processor 18 is then able to select N frequencies for use by the detection system where N is the number of stations for which the system is designed. Once this initial set-up phase is completed the system is ready to be calibrated.

During the calibration procedure, the processor 18 determines the appropriate level for threshold T to provide the desired detection capability. With the system in calibration mode, a human, or a simulated human, crosses the line 10 at its centre. The processor 18 records the peak signal perturbation during this crossing as seen from each end of the line 10. (Where N transmission frequencies are used, it does so for the combination of the N frequencies). The processor 18 uses this peak response together with a sensitivity setting controlled by the user to select an appropriate threshold setting T. This calibration procedure takes into account the length of line 10, its attenuation and the nature of its installation; i.e suspended in air, laid on the ground or buried in the ground.

Since the human, or simulated human, approaches the line at its centre, the intruder-induced perturbation signals at opposite ends of the line 10 should have the same amplitude. If not, the processor 18 adjusts the gain of the demodulators 14S and 14T by means of the variable amplifier 29 (FIG. 2) until they do.

Another way of describing the detection phenomena is to consider that the intruder 28 scatters the plane waves produced by the FM radio transmitter 22. The scattered signal propagates away from the intruder 28 in all directions causing a portion of the signal to be coupled into the open transmission line 10 where it propagates to the start and termination ends. As the intruder 28 approaches the open transmission line 10, an increasing amount of the scattered energy is coupled into the line causing a phase and/or amplitude modulation of the signal received on the open transmission line 10. This causes the combined logarithmic values of magnitude $R_S'$ plus $R_T'$ to increase as the intruder 28 approaches the line 10. At a particular radial distance, the combined response R exceeds the threshold T and the alarm is sounded. Assuming that the radial decay associated with the particular line 10 is uniform along the length of the line, the appropriate selection of a threshold value T determines the width of the detection zone which surrounds the open transmission line. In practice, one might set the threshold T to detect an intruder 28 within one meter of the line. Because the combined response is independent of location along the length of the open transmission line 10, the detection zone is uniform along the length of the line 10, thereby eliminating the need for cable grading. It should be noted that, since the difference ($R_S'-R_T'$) between the logarithmic values is equivalent to the ratio between the perturbation signal magnitudes ($R_S/R_T$), the determination of location does not depend upon the magnitude of the perturbation. In other words, the determination of location is not a function of the radial distance to the intruder from the line.

The performance of the intrusion detection system in terms of Probability of Detection (Pd) and False Alarm Rate (FAR) is largely determined by the Signal to Noise Ratio (SNR) of the system and the processing bandwidth. Because the open transmission line 10 is much less efficient than the reference antenna 20 in receiving the radio transmission, the RF signal received by the reference receiver 16 is much stronger than the signal received by the line receivers 12S, 12T (20 to 30 dB stronger). Hence the line receivers 12S and 12T have considerably more gain than the reference receiver 16 which means that the line receivers 12S and 12T are the primary source of noise, typically thermal noise at the receiver "front end".

The system SNR can be improved by minimizing the bandwidth of the line receivers 12S and 12T. Whereas conventional commercial FM radio receivers utilize 180 KHz of occupied bandwidth in order to accommodate the monaural and stereo transmissions, a much narrower bandwidth will accommodate the 0.005 to 6 Hz. modulation caused by the intruder 28. In order to reduce the line receiver bandwidth while receiving all of the RF energy in the transmitted signal, it is proposed according to the invention to use the reference receiver 16 to track the station modulation. If the reference receiver 16 tracks the station modulation perfectly, the reference local oscillator signal LO contains the modulation signal and the intermediate frequency signal is virtually free of the modulation. Since the LO signal produced by the tracking reference receiver 16 tunes the line receivers 12S and 12T, their intermediate frequency signals $IF_S$ and $IF_T$ are essentially limited to the modulation or perturbation produced by the intruder 28.

Figure 6A:
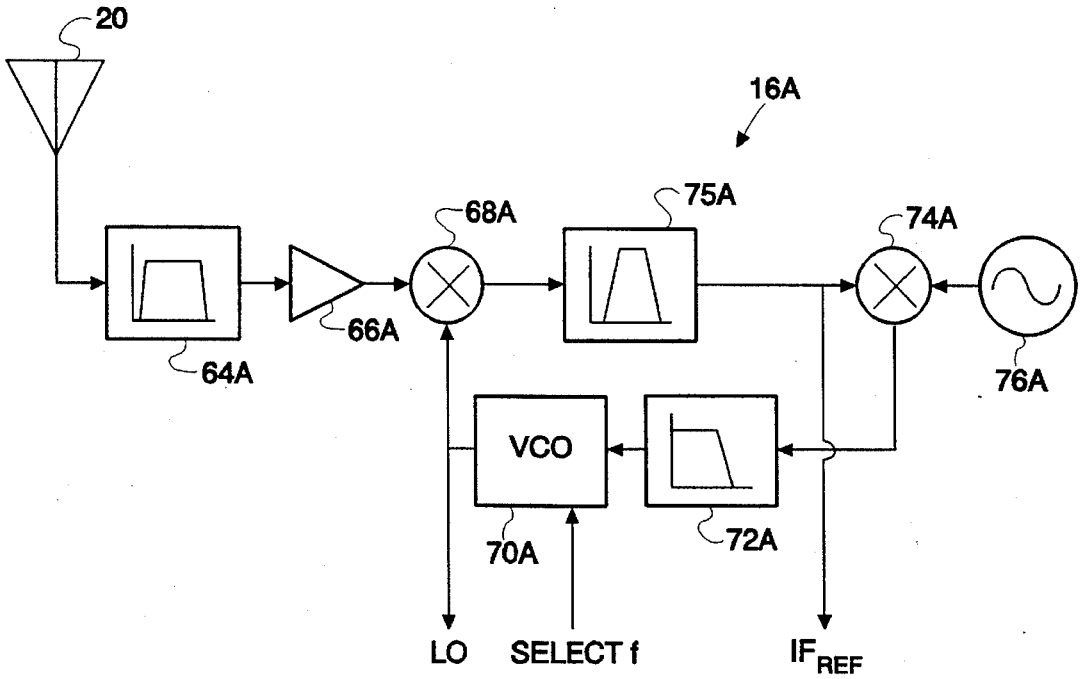
FIGS. 6A and 6B are simplified schematic diagrams of alternative reference receivers for the system of FIG. 1.
Figure 6B:
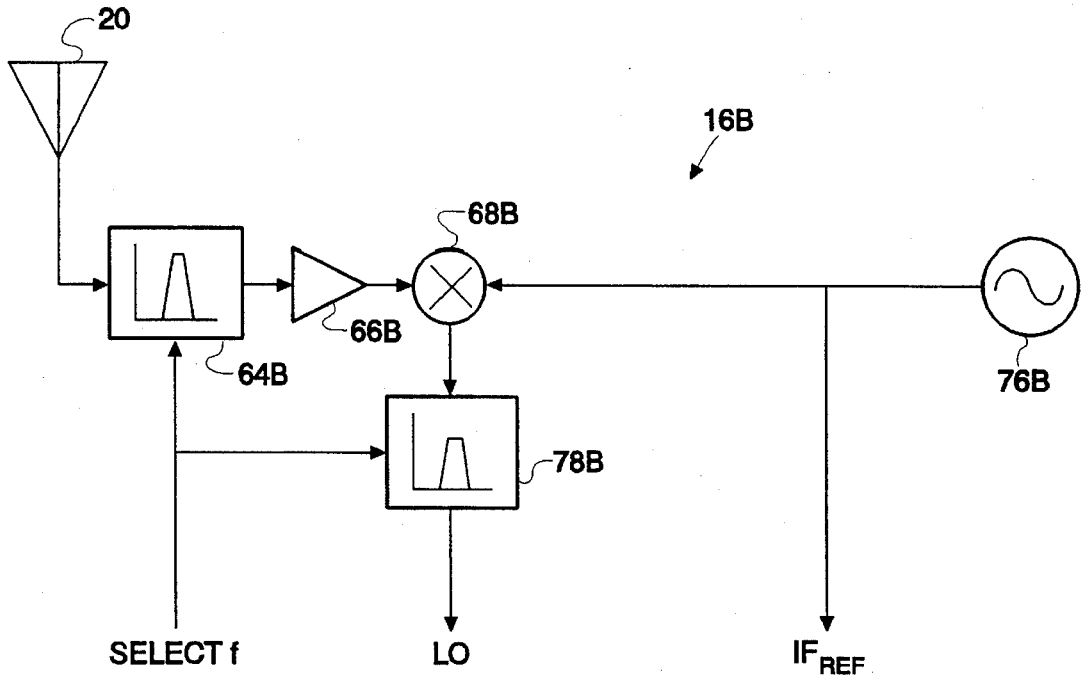

FIGS. 6A and 6B illustrate embodiments of reference receiver which will track the station modulation. In the reference receiver 16A shown in FIG. 6A, the RF signal received on antenna 20 is passed through a broad bandpass filter 64A to eliminate signals from outside the FM band (88 to 108 MHz). The band-limited output of the filter 64A is amplified in a low noise amplifier 66A and passed to a mixer 68A which mixes it with the reference local oscillator signal LO produced by a Voltage Controlled Oscillator (VCO) 70A. The frequency of the VCO 70A is controlled by the SELECT f signal from processor 18. The SELECT f signal is actually a dc voltage that selects the desired station, much as in normal digitally controlled radios. In addition the VCO 70A responds to the output of a Phase Locked Loop (PLL) filter 72A which receives its input from a phase comparator 74A. The reference intermediate frequency signal $IF_{REF}$ is extracted from the output of mixer 68A by filter 75A and compared by phase comparator 74A with a 10.7 MHz reference signal from an oscillator 76A. This PLL circuit tracks the modulation thereby effectively removing the modulation from the intermediate frequency and imposing the modulation on the reference local oscillator signal LO which is sent to the line receivers 12S and 12T.

An alternative approach to the use of a PLL is employed in the reference receiver 16B in FIG. 6B. In this case, the RF signal received by antenna 20 filtered by a tunable station pre-selection filter 64B. The output of filter 64B is passed through a pre-amplifier 66B to a mixer 68B where it is down-converted by a reference 10.7 MHz signal generated by reference oscillator 76B. The output of mixer 68B is filtered in a tunable bandpass filter 78B to produce the desired tracking reference local oscillator signal LO which is used to tune the line receivers 12S and 12T. The tuning of the pre-selection filter 64B and the bandpass filter 78B is controlled by the Select f signal from processor 18.

Reducing the bandwidth from 180 KHz. to 12 Hz. would potentially improve the SNR by 8.35 db. In practice, factors such as the noise figure of the receivers, aliasing during sampling, and approximations made in the digital signal processing limit the improvement which can actually be realized.

Combining the perturbation signals from the ends of the line 10 by taking the sum of their logarithms and comparing this sum to the fixed threshold. T is equivalent to comparing the product of the two perturbation signals to a fixed threshold. This method of combining the two perturbation signals is easy to implement because it results in a single threshold regardless of where the intrusion occurs along the length of the cable. It does, however, reduce the detection Signal to Noise Ratio (SNR) to that of the smallest signal.

In order to enhance SNR, the processor 18 may be programmed instead to use the arithmetic sum of the two perturbation signals, i.e. $R+R_S=R_T$.

In practice, one does not often have a clear line-of-sight path from the transmitting station antenna 22 to all sections of the open transmission line 10. In many applications the electromagnetic fields produced by the radio station at the open transmission line 10 include significant multipath components. For example, a large building can reflect the broadcast plane waves over the open transmission line 10. It is envisaged, therefore, that embodiments of the invention might employ a plurality of different radio frequency signals as references so as to employ frequency and spatial diversity to minimize the effects of multipath components. In virtually all metropolitan areas, there are a number of FM stations within the 88 to 108 MHz band which can be used in the present intrusion detection system. In many cases the transmit antennas are collocated for most of the stations. With collocated transmitters, the time-multiplexing between two or more stations makes it very unlikely that a null can occur at the same location due to frequency diversity. In the case of stations that are not collocated, it is also very unlikely that a null can exist at both frequencies due to both frequency and spatial diversity.

When multiple frequencies are used, it is desirable to take the sum of the perturbation signals corresponding to each end of the line prior to taking the logarithms. In equation form:

$$R_T=\sum_{i=1}^{N} R_{Ti} \text{ and } R_S=\sum_{i=1}^{N} R_{Si}$$

where N is the number of frequencies and the subscript i is used to denote the perturbation signal at frequencies i. This approach averages out any peaks or nulls caused by multipath effects thus improving the overall signal to noise ratio.

Rather than duplicating the reference receiver 16, line receivers 12S and 12T and demodulators 14S and 14T (FIG. 1) for each of the plurality of frequencies, it is possible to time-multiplex the receiver means to measure the response at each of the plurality of frequencies. To achieve this multiplexing, the processor 18 simply uses the SELECT f control signal to cause the reference receiver 16 to switch between the different frequencies alternately. The selected frequencies may be taken from the table of frequencies generated by the processor 18 during the calibration process described earlier. Since the local oscillator signal LO for the line receivers 12S and 12T comes from the reference receiver 16, they automatically track the station switching. The digital signal processor 18 keeps the perturbation signals for each of the different frequencies separate until the final stage where the combined logarithmic responses are added together to get the geometric mean. Combining perturbation signals for a plurality of frequencies in this way effectively "smooths out" peaks and nulls in the perturbation signals.

While the addition of the logarithms of the response magnitudes provides a good way of combining the signal information, it is not optimal in terms of the resulting Signal to Noise Ratio (SNR). From a SNR perspective, it may be desirable to add the response magnitudes prior to taking the logarithm. This would produce the logarithm of the arithmetic means as opposed to the logarithm of the geometric means. In general the SNR of a geometric mean is approximately that of the input signal with the lowest SNR. Hence, even though one of the input signals has an excellent SNR it will be degraded to the SNR of the input signal with a poor SNR. On the other hand if the noise on the input signals has a normal distribution with equal variances, an arithmetic mean can significantly improve the SNR.

In short lengths of line, say 50 meters or less, the line attenuation may be sufficiently small that the difference between the magnitudes of the perturbation signals seen at opposite ends of the line may be less than the variations in magnitude caused by noise. While this would inhibit the location ability of the system according to the present invention, since it is not usually necessary to know the location of an intruder on such a short length of sensor line, there is still considerable SNR benefit to be gained by adding the magnitudes of the perturbation signals from both ends of the line.

Figure 7:
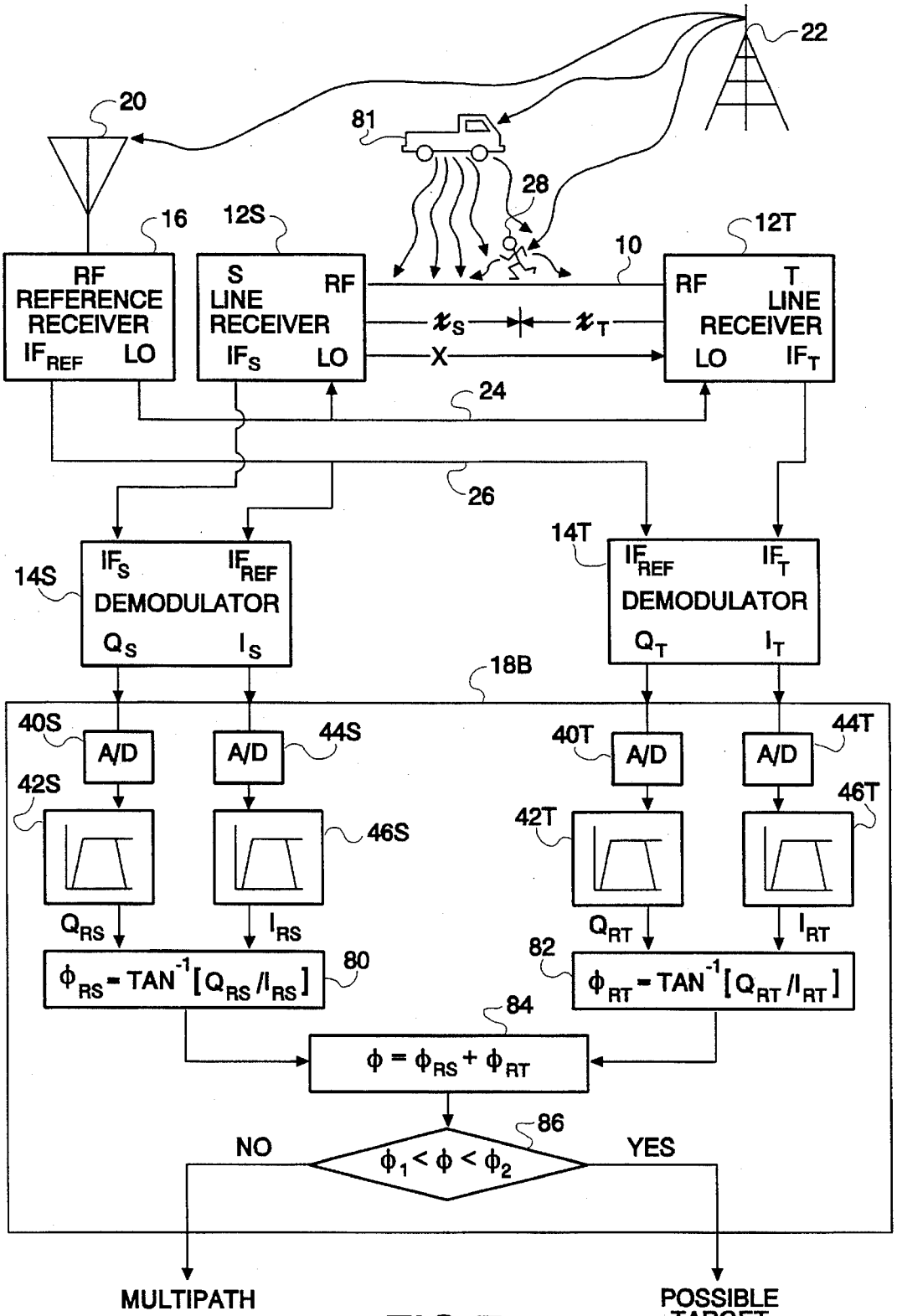
FIG. 7 illustrates multipath discrimination between the signal due to an intruder adjacent the line and signals from large objects further from the line.

The multipath effects described above are basically static in nature as they come from stationary objects and it is assumed that the open transmission line 10 also remains stationary. FIG. 7, which corresponds to FIG. 4, illustrates an embodiment of the invention which deals with a more complex form of multipath distortion, i.e. transient multipath distortion, which is caused by reflections from moving objects such as vehicles on nearby roads. As shown in FIG. 7, a moving vehicle 81 reflects a plane wave over the open transmission line 10. If the open transmission line 10 were perfectly uniform with no irregularities within its near field, the reflection from the moving vehicle 81 would not couple into the open transmission line 10 and would not cause a false alarm. In practice, however, the open transmission line 10 does have many small scattering objects randomly distributed along its length which couple energy into the open transmission line 10. Hence the moving vehicle 81 can cause false alarms by reflecting radio signals onto the fixed but distributed small objects within the field of the open transmission line 10.

In the embodiment illustrated in FIG. 7, the processor 18B uses the intruder phase response information to reduce the number of false alarms due to transient multipath effects from moving distant vehicles. Assuming that the open transmission line 10 operates in a quasi-TEM or surface wave mode, the constant phase fronts close to the open transmission line 10 are virtually orthogonal to the line 10. Hence the phase $\phi_{RS}$ of the intruder perturbation signal $R_S$ via the receiver 12S is the product of the transmission line phase factor, β, and the distance $X_S$ from the start of the line 10 to the intruder 28. Likewise, the phase $\phi_{RT}$ of the perturbation signal $R_T$ received by line receiver 12T is the product of the transmission line phase factor, β, and the distance $X_T$. i.e.

$$\phi_{RS}=\beta X_S \text{and } \phi_{RT}=\beta X_T$$

Once the intrusion detection system is installed, the length of the open transmission line 10 is fixed so the sum of these two phase factors is a constant, i.e.

$$\phi=\phi_{RS}+\phi_{RT}=\beta X$$

where X is the length of the open transmission line 10. The constant $\phi$ is independent of the intruder location along the open transmission line 10. The signal injected by the distant moving vehicle 81 into the open transmission line 10 enters at random locations along the line and the phase angle $\phi$ will be time-varying as the vehicle 81 moves. Hence, the processor 18B computes $\phi_{RS}$, the phase of the incremental response vector at the start; $\phi_{RT}$, the phase at the termination end; and sums them to give the phase angle $\phi$, as indicated by function boxes 80, 82 and 84, respectively. In step 86, the processor 18B compares $\phi$ with threshold values $\phi_1$ and $\phi_2$ to discriminate between perturbations due to intruders near the open transmission line 10 and perturbations due to large moving vehicles at a distance from the line 10.

Figure 8:
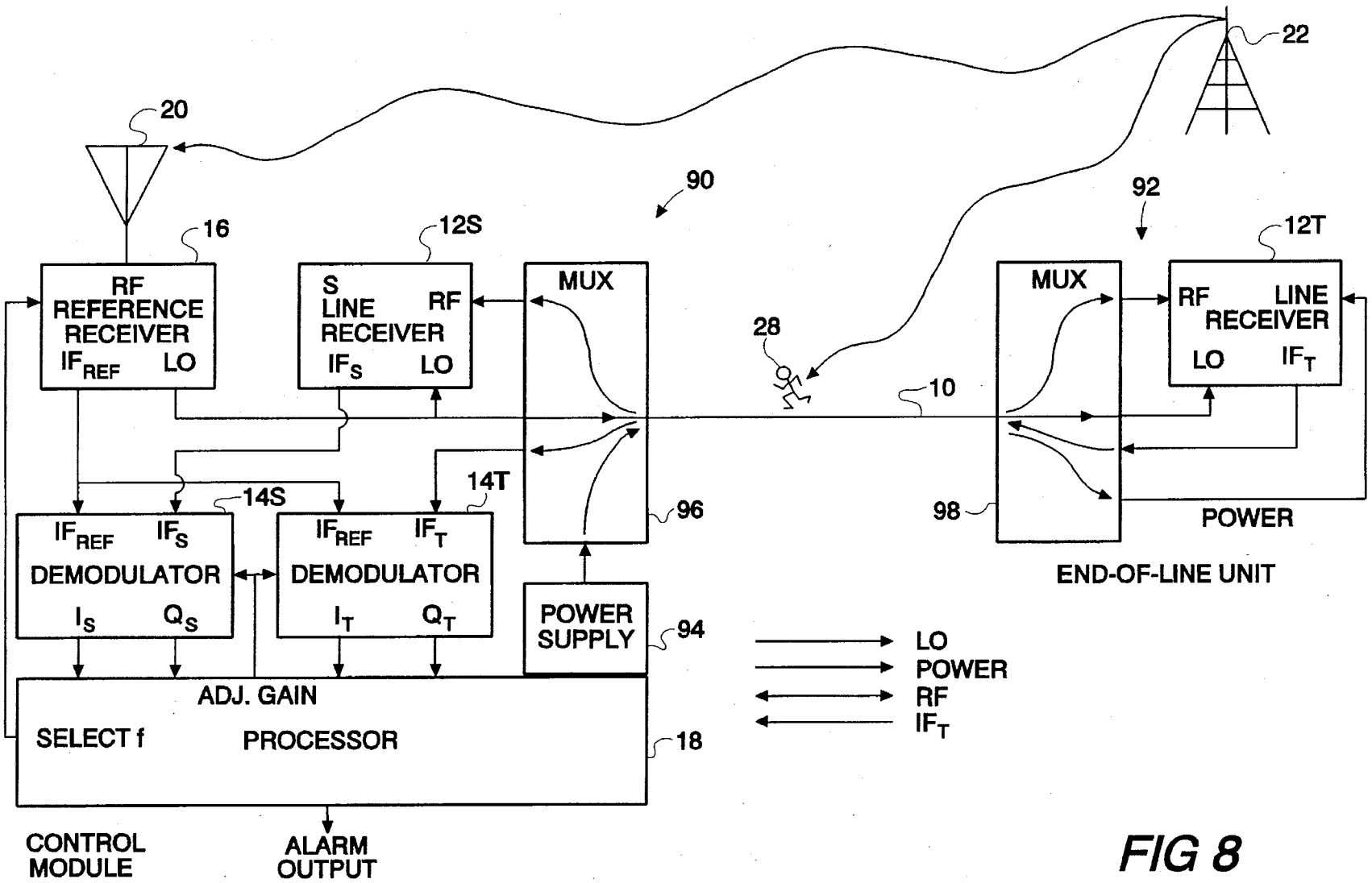
FIG. 8 is a schematic diagram of an embodiment of the invention in which power and reference signals transmitted between line receivers at opposite ends of the line travel via the open transmission line itself.

It will be appreciated that the embodiment of the invention shown in FIG. 1 requires three interconnecting cables; open transmission line 10, line 24 for the reference local oscillator signal, and line 26 for the reference intermediate frequency signal, as well as some means of connecting the demodulators 14S and 14T to the processor unit 18, and a power distribution network. This number of interconnecting cables could make the sensor procurement and installation costs prohibitive. FIG. 8 illustrates an embodiment of the invention in which a control module 90 at the start end of the open transmission line 10 and an end-of-line or termination unit 92 at the other end are interconnected only by the open transmission line 10, the various signals being carried by the line 10 itself.

Thus, the control module 90 comprises a reference receiver 16, line receiver 12S, demodulators 14S and 14T, and a processor unit 18, all similar to those described with reference to FIG. 1. In addition, the control module 90 comprises a power supply 94 and a multiplexer unit 96. The end-of-line or termination unit 92 comprises line receiver 12T and a multiplexer unit 98. D.c. power from the power supply unit 94 and the local oscillator signal LO from the reference receiver 16 in the control module 90 are transmitted by way of the multiplexer units 96 and 98 to the line receiver 12T in the end-of-line unit 92. The intermediate frequency signal $IF_T$ from the line receiver 12T is returned to the demodulator 14T by way of the multiplexers 98 and 96. In addition, the open transmission line 10 carries the RF signal coupled into it along its length in both directions to the line receivers 12S and 12T, respectively, by way of multiplexers 98 and 96.

The control module 90 may be designed to operate in an indoor environment and the end-of-line unit 92 designed to operate in either an indoor or an outdoor environment. Multiplexing the signals on the open transmission line 10 avoids the cost of additional cable and installation to incorporate the termination line receiver.

In order to further simplify the hardware illustrated in FIG. 8, it is possible to time multiplex the demodulators 14S and 14T. When this is done, care must be taken to ensure that the multiplexing ratio is sufficiently fast that the intruder 28 has not moved an appreciable distance between samples. The processor 18 will control the multiplexing and allow for it in detecting and combining the perturbation signals from opposite ends of the line.

It should be noted that the use of the end-of-line receiver provides an automatic form of self test for the open transmission line 10. This can easily be used to replace the normal tamper detection circuitry required in security sensors to detect when the cable is damaged.

Figure 10:
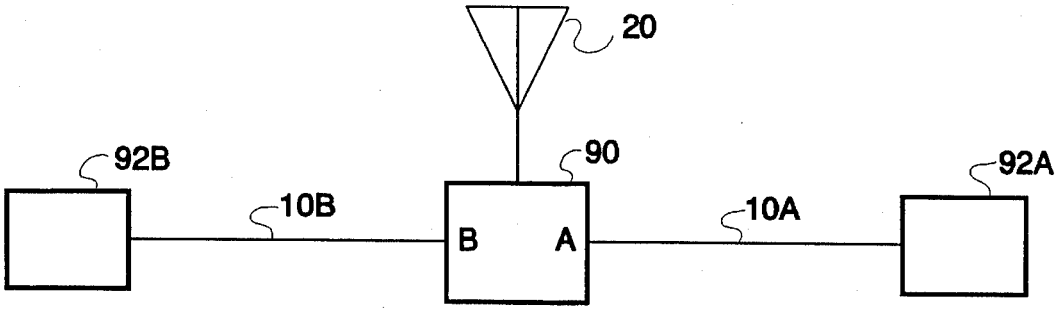
FIGS. 10, 11 and 12 illustrate modifications of the system.

As illustrated in FIG. 10, in order to make the best possible utilization of the processing hardware, the central control module 90 can be time-multiplexed between two open transmission lines 10A and 10B terminated by termination units 92A and 92B, respectively. This allows one to have two lengths of open transmission line 10A and 10B for one reference antenna 20, one reference receiver 16, one line receiver 12S, one pair of demodulators 14S and 14T and one processor unit 18.

Figure 11:
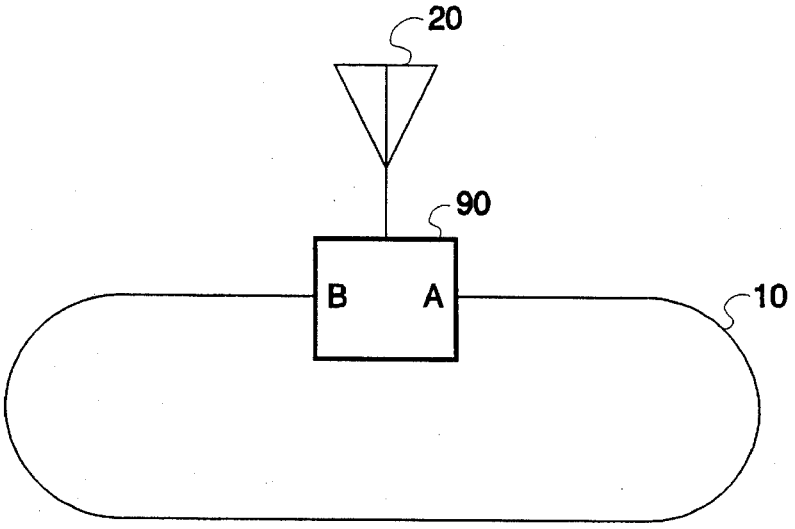

FIG. 11 illustrates another of the many ways that systems with a common, time multiplexed control module 90 can be adapted to address specific applications. FIG. 11 illustrates a closed loop system in which the end-of-line receivers 92 are eliminated by connecting the line 10 between the A and B ports of the control module 90. Appropriate changes in the processing software of processor 18 enable ports A and B to replace start S and termination T in the more general application. It should be noted that, in this embodiment of the invention, one does not need to communicate the signals over the open transmission line 10 since the control module 90 has access to both ends of the line 10.

Figure 12:
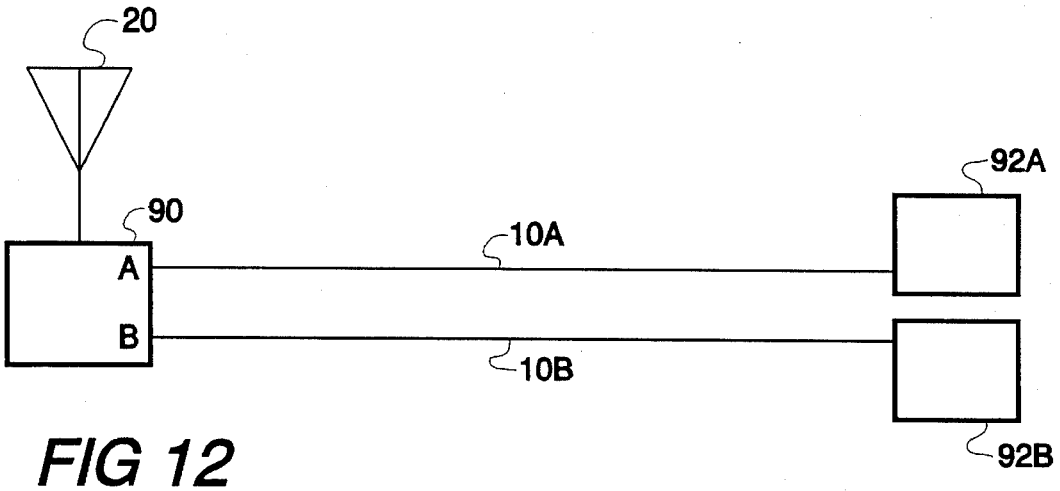

FIG. 12 illustrates the two open transmission lines 10A and 10B installed parallel to each other. This approach enlarges the detection zone and allows one to combine the detection results to lower the false alarm rate or to provide the direction of crossing.

Figure 9:
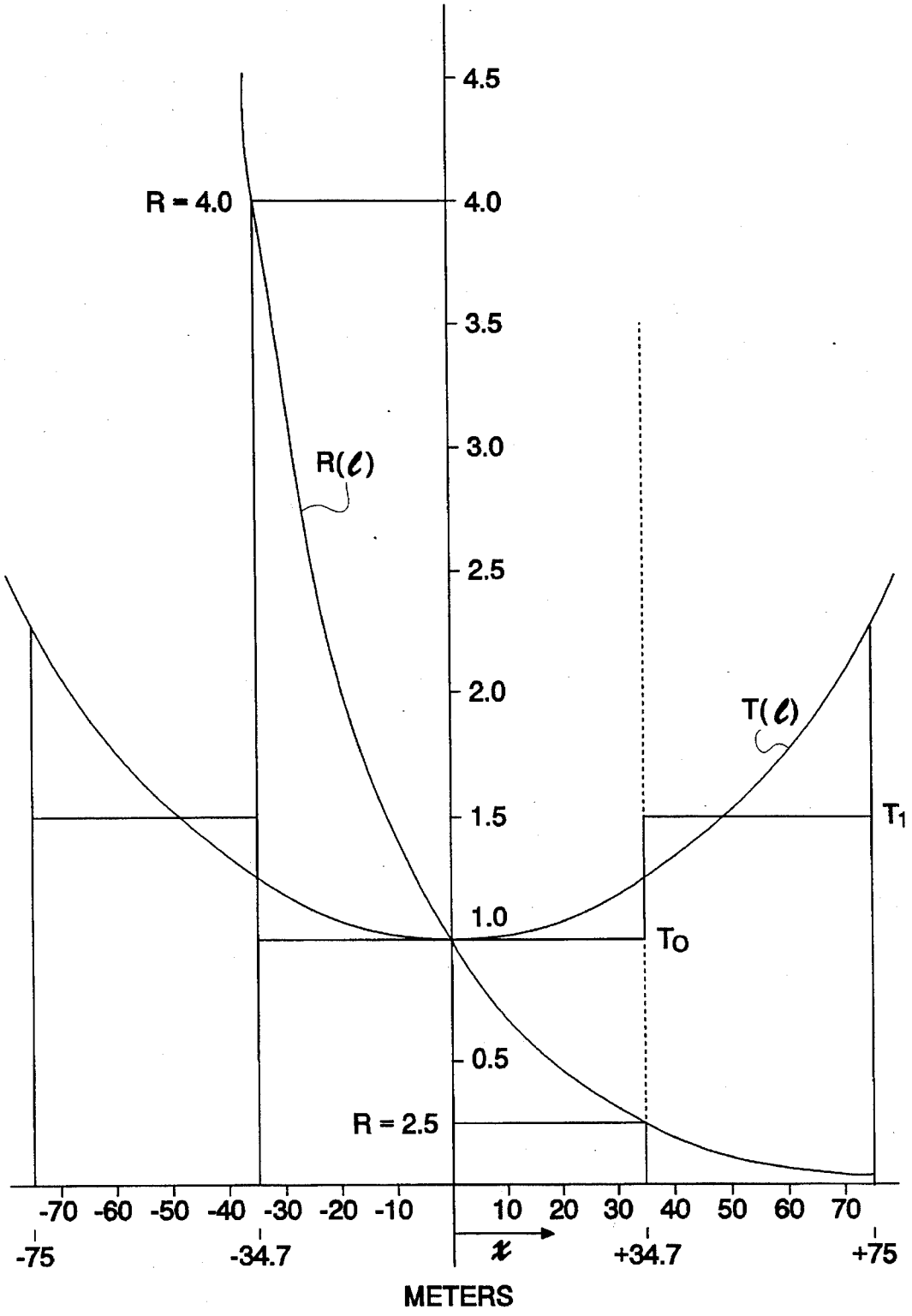
FIG. 9 depicts variation of thresholds with distance along the line for an alternative embodiment of the invention.

Various modifications of the described embodiments of the invention are comprehended by the present invention. Thus, in order to maintain a uniform detection zone size with a constant probability of detection along the length of the line 10, the processor 18 may compare the average magnitude R to a threshold which is a function of the location of the intrusion along the length of the line 10. Where multiple frequencies are involved, the average magnitude R will be obtained by summing the start perturbation signals for all frequencies, summing the termination perturbation signals for all frequencies and taking the average. Since the signals propagating inside the line 10 attenuate exponentially with distance along it, the processor 18 will determine the threshold using the function $$T(1)=T_0 \text{ Cos h } (\alpha l)$$

where $T_0$ is the threshold at the centre of the line 10, 1 is the distance from the centre of the line in meters, and α is the attenuation of the cable in Nepers per meter. FIG. 9 illustrates the function T(1) to provide uniform detection for a line with 18 dB of attenuation per meter.

Thus, the processor 18 will combine the start and termination perturbations signals and then determine the approximate location of the intruder so as to compare the magnitude R to the appropriate threshold. Since the signals attenuate exponentially from each end of the line 10, the ratio between the two perturbation signals is used to estimate the location of the intrusion along the length of the line using the expression:

$$\frac{R_S}{R_T}(l) = e^{-2\alpha l}$$

Figure 13:
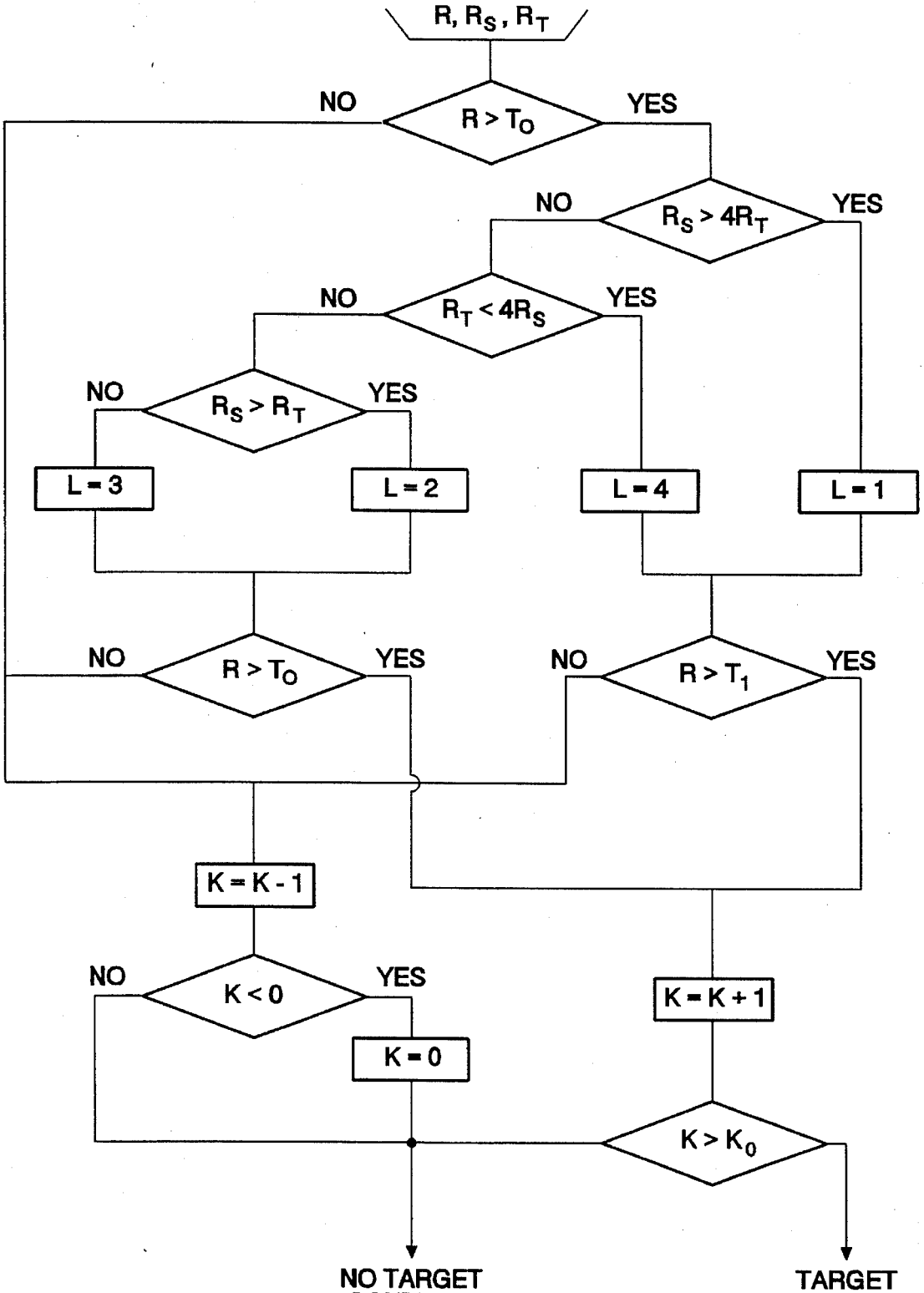
FIG. 13 illustrates variation of detection threshold according to distance from the end of the line.

It is envisaged that the programming of processor 18 might be further modified to make a stepwise approximation to the ideal threshold curve shown in FIG. 9 as a function of simple binary ratios of $R_S/R_T$ so as to avoid performing the division, the logarithm and the cosh function. As shown in FIG. 9, for the line quarter-sections adjacent the centre of the line 10, the threshold is $T_0$, the level set by the user during calibration, as mentioned previously. For the quarter sections adjacent the ends of the line, 10, the threshold is $T_1$ where $T_1=1.5T_0$. The operation of processor 18 to process the signals using a variable threshold is illustrated in FIG. 13.

The reference receiver antenna 20 should be located so as to obtain the strongest signal from the station transmitter tree of time-varying multipath signals such as those which could be caused by nearby vehicular traffic.

Although it will not be a problem in most cases, there may be applications where it is not possible to restrict movement of the reference antenna 20 or restrict movement of people or objects near to it. Because the system has a line receiver at each end of the line 10, and both phase and magnitude information of the baseband signals $M_S$ and $M_T$ is available from both ends, additional processing can be used to reduce false alarms due to motion of the reference antenna and/or people or objects close to it. Because such motion will cause an identical change in the phases of the baseband signal vectors $M_S$ and $M_T$, but not affect their amplitudes, the processing could be arranged so that no alarm was declared if the phase changes of both baseband signals were the same and their magnitudes were unchanged.

Figure 14:
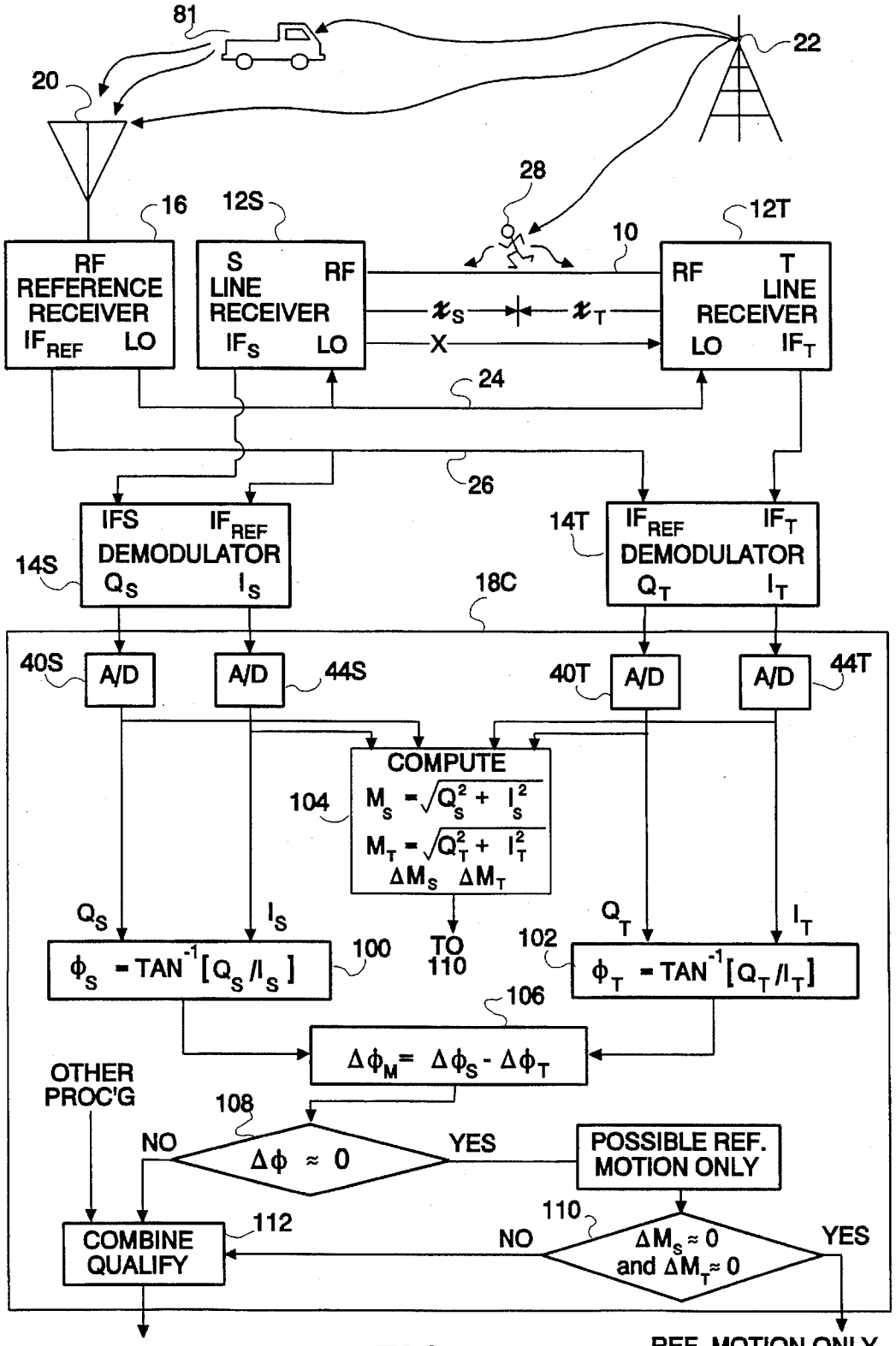
FIG. 14 illustrates another modification of the system.

Such additional processing is shown in FIG. 14, in which components corresponding to those in FIG. 7 have the same reference numeral. The processor means is identified by reference numeral 18C, the suffix "C" indicating that it differs from those of FIG. 4 and FIG. 7 in that it provides the additional processing.

In the processor means 18C of FIG. 14, the components $Q_{RS}$, $I_{RS}$ and $Q_{RT}$, $I_{RT}$ are extracted by A/D converters 40, filtered using bandpass filters and processed as described before with reference to FIG. 7. For convenience of illustration, such bandpass filtering and other processing are designated as "OTHER PROC'G" in FIG. 14, only the additional processing being illustrated in detail.

Referring to FIG. 14, following digitization by the A/D converters 40S, 44S, 40T and 44T, the baseband signal components $Q_S$,$I_S$ and $Q_T$,$I_T$ are processed as shown by function boxes 100 and 102 to determine the phase values $\phi_S$ and $\phi_T$, respectively, of the baseband signal vectors $M_S$ and $M_T$. The magnitudes of the baseband vectors $M_S$ and $M_T$ also are computed from their components $Q_S$,$I_S$ and $Q_T$,$I_T$, respectively, as indicated by function box 104. A truck 81 is shown moving so close to the reference antenna 20 that it interferes with the signal from transmitter 22. The motion of the truck 81 causes an identical change in the respective phases $\phi_S$ and $\phi_T$ of baseband signals $M_S$ and $M_T$ (FIGS. 5A and 5B) but does not affect the amplitudes of baseband signals $M_S$ and $M_T$ because the reference receiver 16 "hard" limits to a fixed amplitude. As indicated by function box 106, the phase value changes $\Delta\phi_S$ and $\Delta\phi_T$ are subtracted to give the differential phase change $\Delta\phi_M$ between the baseband vectors. If there is a differential phase change, as detected by a positive result from comparison step 108, the possibility of the change being due to motion of, or at, the reference antenna 20 is determined by comparison step 110 which detects changes in amplitude of both $M_S$ and $M_T$. If both amplitudes have not changed, the changes are attributed to motion at or of the reference antenna.

If comparison steps 108 and 110 both give negative outputs, i.e. the differential phase changed and one or both of the magnitudes $M_S$ and $M_T$ changed, a "possible target" is indicated, as determined by function box 112.

It should be appreciated that the processing to find R (FIG. 4) and $\phi$ (FIG. 7) still contributes to the POSSIBLE TARGET decision. The outputs of decision steps 108 and 110 are used, as indicated by combination function box 112, to qualify the results of the other processing which, as previously mentioned,is designated as OTHER PROC'G.

Other approaches are also envisaged to deal with motion at, or of, the reference antenna. Thus, it would be possible to measure response as change in magnitude of the vector extending between the tips of the baseband signal vectors $M_S$ and $M_T$. The length of this vector will not change if $M_S$ and $M_T$ both rotate in the same way with no change in amplitude, but will change if an intruder causes a non-correlated change in either amplitude or phase of $M_S$ and $M_T$. This method requires accurate calculations, especially when clutter is large relative to intruder response, and can involve singularity problems if the target is much larger than clutter.

A third approach is to "normalize" the response by rotating the vector plane by the phase response of one end (preferably the one with the larger clutter as this will give more accurate measurement of phase angle), or some function of the phase response of both ends, such as the average. This would eliminate response due to mutual phase shift, while still responding to amplitude response or non-correlated phase response, as would be generated by an intruder.

In areas where there is no FM radio station, the intrusion detection system according to the invention can be operated by providing a local CW transmission in the FM band. Naturally this will require radio regulatory approval.

Because of the popularity of FM radio, many types of low cost antennas are readily available as the reference antenna 20. Likewise the electronic circuitry required in the reference receiver 16 and the line receivers 12S, 12T may employ inexpensive sophisticated integrated circuits developed for the entertainment industry.

The open transmission line 10 can be virtually any type of transmission line that supports an external electromagnetic field. Perhaps the simplest such transmission line is a wire suspended above ground to form an Image Line. Other suitable open transmission lines are Two Wire Lines, Strip Line and Surface Wave Lines. The key properties of such an open transmission line as it relates to the present invention are that it guides an electromagnetic field along its length at a known velocity of propagation with minimal radiation and with a field that decays with radial distance. The radial decay rate determines the size of the detection zone.

Embodiments of the invention yield various advantages over known systems. For example, embodiments using only one cable involve reduced costs. The intruder detection system may be passive which simplifies production and obviates the need for FCC approval or approval of other regulatory bodies. Embodiments which use a commercial FM radio signal may use parts which are relatively cheap because they are available for FM radio receivers. The use of multiple reference signal frequencies enhances signal to noise ratio and reduces multipath effects while increasing reliability.

In the preferred embodiment the radio station is a commercial FM radio station operating in the 88 to 108 MHz band of frequencies. Electromagnetic fields at these frequencies are ideal for detecting human intruders while rejecting small animals and birds because an adult human is between one quarter and one half wavelength tall causing it to have considerably larger radar cross section than a small animal which may only be one tenth of a wavelength tall. Commercial FM radio stations are also ideal because there are usually many such stations in urban areas where crime is prevalent and security is required and because they typically transmit twenty four hours a day.

An advantage of embodiments of the present invention, which deploy a receiver at each end of the open transmission line, is that they provide substantially uniform sensitivity without the expense and inconvenience of cable grading. Embodiments of the invention which employ transmissions from two or more stations, also give enhanced performance through the use of frequency diversity which, together with the spatial diversity arising from the use of receivers at each end of the line, significantly improves the sensor performance in terms of uniformity of detection along the line length as well as providing a higher probability of detection and lower false alarms ratio than conventional single frequency, single ended leaky cable sensors.

Although embodiments of the invention have been described and illustrated in detail, it is to be clearly understood that the same is by way of illustration and example only and is not to be taken by way of limitation, the spirit and scope of the present invention being limited only by the appended claims.

What is claimed is:

1. An intrusion detection system comprising:

an open transmission line; receiver means connected to both ends of the transmission line; means for providing at the receiver means a reference local oscillator signal and a reference intermediate frequency signal 4, the receiver means being responsive to the reference local oscillator signal and the reference intermediate frequency signal to extract from a first radio frequency signal received at one end of the line a first baseband signal comprising a first perturbation signal and to extract from a second radio frequency signal received at the other end of the line a second baseband signal comprising a second perturbation signal, the first and second perturbation signals being produced contemporaneously by an intruder in proximity to the line, and processor means for processing first baseband signal and the second baseband signal to provide a combined response signal in dependence upon both the first perturbation signal and the second perturbation signal and in inverse proportion to attenuation of the radio frequency signals by the line, and determining presence of the intruder in dependence upon the combined response signal.

2. An intrusion detection system as claimed in claim 1, wherein the processor means compares the combined response signal with a threshold to determine presence of the intruder.

3. A system as claimed in claim 2, wherein the processor means is arranged to compare the combined response signal with a said threshold which varies according to position of the intruder along the length of the line.

4. A system as claimed in claim 3, wherein the processor means is arranged to vary the threshold in accordance with the expression:

$$T(l)=T_0 \cos h\,(\alpha l)$$

where $T_0$ is the threshold at the center of the line, l is the distance from the center of the line in meters to the position of the intruder and $\alpha$ is the attenuation of the line in nepers per meter.

5. A system as claimed in claim 2, wherein the processor means is arranged to determine from the first and second perturbation signals the location of the intruder relative to the ends of the line, select one of a predetermined plurality of threshold levels according to said location, a minimum of said levels corresponding to the center of the line and maxima of said levels corresponding to respective end portions of the line, and to compare the combined response signal with the selected one of the threshold levels.

6. An intrusion detection system as claimed in claim 1, wherein said first baseband signal and said second baseband signal comprise, in addition to the first and second perturbation signals, respectively, first and second clutter components, respectively, outside a predetermined frequency range and the processor means is arranged to remove the first and second clutter components before combining the first and second perturbation signals to provide said combined response signal.

7. An intrusion detection system as claimed in claim 6, wherein the predetermined frequency range is from about 0.005 Hertz to about 6 Hertz.

8. An intrusion detection system as claimed in claim 1, wherein the processor means is arranged to sum logarithmic values of said first perturbation signal and said second perturbation signal, respectively, in providing said combined response signal.

9. An intrusion detection system as claimed in claim 1, wherein the processor means is arranged to compute the difference between a logarithmic value of the first perturbation signal and a logarithmic value of the second perturbation signal, and to determine the location of the intruder by comparing the difference with a reference dependent upon the length of the line.

10. An intrusion detection system as claimed in claim 1, wherein the receiver means comprises a first line receiver connected to said one end of the line and a second line receiver connected to said other end of the line, the first line receiver being responsive to the reference local oscillator signal to derive from the first radio frequency signal a first intermediate frequency signal comprising intruder-induced perturbations, the second line receiver being responsive to the reference local oscillator signal to derive from the second radio frequency signal a second intermediate frequency signal comprising corresponding intruder-induced perturbations, a first demodulator means responsive to the first intermediate frequency signal and the reference intermediate frequency signal to derive said first baseband signal, and a second demodulator means responsive to the second intermediate frequency signal and the reference intermediate frequency signal to derive said second baseband signal.

11. An intrusion detection system as claimed in claim 10, wherein the first demodulator means and second demodulator means derive the first baseband signal and second baseband signal, respectively, in the form of in-phase and quadrature components, and the processor means combines the sum of the squares of the in-phase and quadrature components of each of the first baseband signal and second baseband signal.

12. An intrusion detection system as claimed in claim 11, wherein the processor means is further arranged to remove clutter components outside a predetermined frequency range.

13. An intrusion detection system as claimed in claim 12, wherein the predetermined frequency range is from about 0.005 Hertz to about 6 Hertz.

14. An intrusion detection system as claimed in claim 10, wherein each of the means for providing a reference local oscillator signal, the first line receiver, and the processor means is located at, and coupled to, said one end of the line, the second line receiver is located at said other end of the line, the reference local oscillator signal is supplied to the second line receiver by way of the line and the second intermediate frequency signal from the second line receiver is returned by way of the line to the second demodulator means.

15. An intrusion detection system as claimed in claim 14, wherein the receiver means further comprises first multiplexer means coupling each of the first line receiver, the means for providing the reference local oscillator signal and reference intermediate frequency signal, the first demodulator means, and the second demodulator means, to the first end of the line and second multiplexer means coupling the second line receiver to the other end of the line, the arrangement being such that the reference local oscillator signal and reference intermediate frequency signal are coupled to the second line receiver by way of the first multiplexer means, the second multiplexer means and the line, and the second intermediate frequency signal is returned from the second line receiver to the second demodulator means by way of the first multiplexer means, the second multiplexer means and the line.

16. An intrusion detection system as claimed in claim 1, wherein the processor means is further arranged to determine the respective phase angles of the first perturbation signal and second perturbation signal and to determine an intruder to be present when the sum of the phase angles is within a predetermined range.

17. A system as claimed in claim 1, wherein the first radio frequency signal and the second tsfio frequency signal result from coupling to the open transmission line a radiated radio frequency signal and the means for providing comprises a reference receiver for receiving the radiated radio frequency signal without perturbation by the intruder and generating therefrom the reference local oscillator signal and the reference intermediate frequency signal.

18. A system as claimed in claim 17, wherein the processor means is further arranged to compensate for variations in the baseband signals caused by either or both of motion of an object near an antenna of the reference receiver and motion of the antenna itself.

19. A system as claimed in claim 18, wherein the processor means is arranged to compensate for the variations by computing differences between changes in phase of the first baseband signal and second baseband signal, computing the amplitude of each of the first baseband signal and second baseband signal, and inhibiting the determination of the presence of an intruder when a variation in the baseband signals is not accompanied by a difference between the changes in phase and by a change in amplitude of at least one of the baseband signals.

20. A system as claimed in claim 1, wherein the receiver means is arranged to receive, selectively, a plurality of transmissions at different frequencies and the processor means is arranged to combine a corresponding plurality of first perturbation signals at the different frequencies for said one end of the line and a corresponding plurality of second perturbation signals for said other end of the line.

21. A system as claimed in claim 20, wherein the processor means is arranged to select a particular transmission frequency and adjust gain of said receiver means to a corresponding value thereby to compensate for different signal strengths of the different transmissions.

22. A system as claimed in claim 20, wherein the processor means is arranged to derive the combined response signal by summing the plurality of first perturbation signals, summing the plurality of second perturbation signals, computing the logarithmic value of each sum so produced, and summing the logarithmic values in providing said combined response signal.

23. A system as claimed in claim 20, wherein the processor means is arranged to sum the plurality of first perturbation signals, sum the plurality of second perturbation signals, add the first sum and the second sum, and compute the logarithm of the result in providing said combined response signal.

24. A system as claimed in claim 1, wherein the receiver means is arranged to receive, selectively, a plurality of transmissions at different frequencies and the processor means is arranged to sum a corresponding plurality of first perturbation signals at the different frequencies for said one end of the line, sum a corresponding plurality of second perturbation signals at the different frequencies for said other end of the line, combine the first sum and second sum in providing said combined response signal, and wherein the processor means is arranged to select one of a plurality of threshold levels, a minimum of said levels corresponding to the center of the line and maxima of said levels corresponding to respective end portions of the line, and compare the combined response signal with the selected threshold level.

25. A system as claimed in claim 24, wherein the processor means is arranged to select the particular level in dependence upon a ratio between the first sum and second sum.

* * * * *